US010737491B2

(12) United States Patent
Odaka et al.

(10) Patent No.: US 10,737,491 B2
(45) Date of Patent: Aug. 11, 2020

(54) LIQUID DISCHARGE HEAD, LIQUID DISCHARGE DEVICE, AND LIQUID DISCHARGE APPARATUS

(71) Applicants: Toshimichi Odaka, Kanagawa (JP); Takahiro Yoshida, Kanagawa (JP); Takakazu Kihira, Kanagawa (JP)

(72) Inventors: Toshimichi Odaka, Kanagawa (JP); Takahiro Yoshida, Kanagawa (JP); Takakazu Kihira, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/274,380

(22) Filed: Feb. 13, 2019

(65) Prior Publication Data

US 2019/0263119 A1 Aug. 29, 2019

(30) Foreign Application Priority Data

Feb. 23, 2018 (JP) ..... 2018-030449

(51) Int. Cl.

| | |
|---|---|
| ***B41J 2/14*** | (2006.01) |
| ***B41J 2/175*** | (2006.01) |
| ***B41J 2/185*** | (2006.01) |
| ***B41J 2/165*** | (2006.01) |
| ***B41J 2/18*** | (2006.01) |

(52) U.S. Cl.

CPC ..... *B41J 2/14233* (2013.01); *B41J 2/165* (2013.01); *B41J 2/175* (2013.01); *B41J 2/18* (2013.01); *B41J 2/185* (2013.01); *B41J 2002/14419* (2013.01); *B41J 2202/12* (2013.01)

(58) Field of Classification Search

CPC ..... B41J 2/18; B41J 2/1721; B41J 2/14233; B41J 2/165; B41J 2/175; B41J 2/185; B41J 2202/12; B41J 2202/21; B41J 2002/1853; B41J 2002/14419

See application file for complete search history.

(56) References Cited

U.S. PATENT DOCUMENTS

| | | | |
|---|---|---|---|
| 2008/0143793 | A1 | 6/2008 | Okuda |
| 2010/0214334 | A1* | 8/2010 | Kusunoki et al. ..... B41J 2/18 |

(Continued)

FOREIGN PATENT DOCUMENTS

| | | |
|---|---|---|
| JP | 2014-188837 | 10/2014 |
| JP | 2017-056664 | 3/2017 |

(Continued)

*Primary Examiner* — Juanita D Jackson

(74) *Attorney, Agent, or Firm* — Oblon, McClelland, Maier & Neustadt, L.L.P.

(57) ABSTRACT

A liquid discharge head includes a plurality of nozzles, a plurality of individual liquid chambers, a common supply channel, and a common collection channel. The plurality of nozzles discharges a liquid. The plurality of individual liquid chambers communicates with the plurality of nozzles, respectively. The common supply channel communicates with the plurality of individual liquid chambers. The common collection channel communicates with the plurality of individual liquid chambers. At least a part of at least one of the common supply channel and the common collection channel is disposed at a position overlapping with the plurality of individual liquid chambers when the plurality of individual liquid chambers is projected in a vertical direction.

20 Claims, 11 Drawing Sheets

(56) References Cited

U.S. PATENT DOCUMENTS

| | | | |
|---|---|---|---|
| 2011/0069118 | A1 | 3/2011 | Ohzeki et al. |
| 2013/0208059 | A1 | 8/2013 | Arimoto |
| 2015/0062255 | A1 | 3/2015 | Sasaki |
| 2016/0185113 | A1 | 6/2016 | Yoshida et al. |
| 2017/0120602 | A1 | 5/2017 | Nakai et al. |
| 2017/0297333 | A1 | 10/2017 | Kohda et al. |
| 2018/0072066 | A1 | 3/2018 | Yoneta |

FOREIGN PATENT DOCUMENTS

| | | |
|---|---|---|
| JP | 2017-077643 | 4/2017 |
| JP | 2017-087708 | 5/2017 |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-030449, filed on Feb. 23, 2018, in the Japan Patent Office, the entire disclosure of which is incorporated by reference herein.

BACKGROUND

Technical Field

Aspects of the present disclosure relate to a liquid discharge head, a liquid discharge device, and a liquid discharge apparatus.

Related Art

As a liquid discharge head that discharges a liquid, an individual liquid chamber circulation type head is known which circulates a liquid via an individual liquid chamber (also referred to as a pressure chamber).

SUMMARY

In an aspect of the present disclosure, there is provided a liquid discharge head that includes a plurality of nozzles, a plurality of individual liquid chambers, a common supply channel, and a common collection channel. The plurality of nozzles discharges a liquid. The plurality of individual liquid chambers communicates with the plurality of nozzles, respectively. The common supply channel communicates with the plurality of individual liquid chambers. The common collection channel communicates with the plurality of individual liquid chambers. At least a part of at least one of the common supply channel and the common collection channel is disposed at a position overlapping with the plurality of individual liquid chambers when the plurality of individual liquid chambers is projected in a vertical direction.

In another aspect of the present disclosure, there is provided a liquid discharge device that includes the liquid discharge head.

In still another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
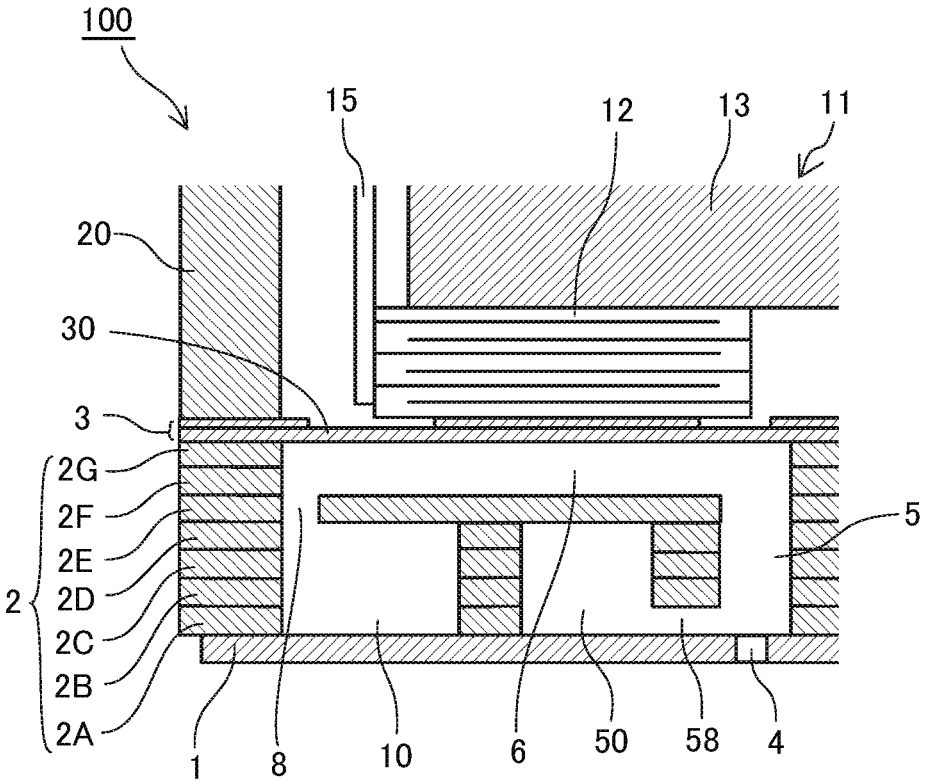
FIG. 1 is an explanatory cross-sectional view in a direction orthogonal to a nozzle arrangement direction of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
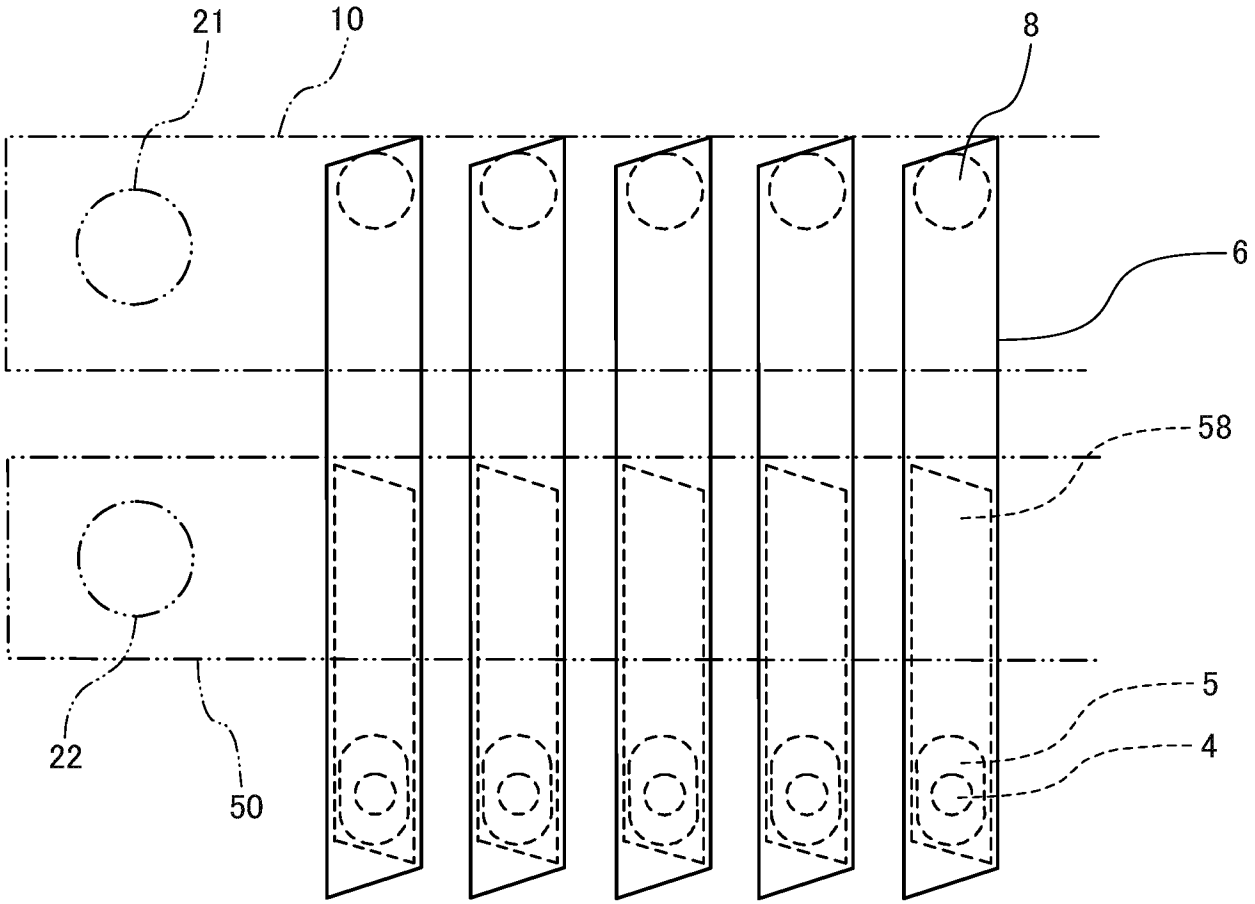
FIG. 2 is an explanatory plan view of the head.

Hereinafter, embodiments of the present disclosure will be described with reference to the attached drawings. A first embodiment of the present disclosure will be described with reference to FIGS. 1 and 2. FIG. 1 is an explanatory cross-sectional view in a direction orthogonal to a nozzle arrangement direction of a liquid discharge head according to the first embodiment. FIG. 2 is an explanatory plan view of the head. FIG. 2 is a view of a side of nozzles viewed from individual liquid chambers.

A liquid discharge head 100 has a nozzle plate 1, a channel plate 2, and a diaphragm member 3 as a wall surface member laminated and bonded to each other, includes a piezoelectric actuator 11 and a frame member 20.

The nozzle plate 1 has a plurality of nozzles 4 to discharge a liquid.

The channel plate 2 includes a plurality of (in this case, seven) plate members 2A to 2G, and forms a plurality of individual liquid chambers (pressure chambers) 6 communicating with the plurality of nozzles 4 via nozzle communication channels 5, respectively. The channel plate 2 forms a common supply channel 10 communicating with the plurality of individual liquid chambers 6 via individual supply channels 8, and a common collection channel 50 communicating with the plurality of individual liquid chambers 6 via individual collection channels 58 and the nozzle communication channels 5.

The frame member 20 forms a supply port 21 communicating with the common supply channel 10 and a collection port 22 communicating with the common collection channel 50.

The diaphragm member 3 has a deformable vibration region 30 forming a wall surface of each of the individual liquid chambers 6 of the channel plate 2. Here, the diaphragm member 3 has a two-layer structure (not limited), and is formed of a first layer forming a thin portion from a side of the channel plate 2 and a second layer forming a thick portion. The first layer forms the deformable vibration region 30 in a portion corresponding to the individual liquid chambers 6.

A piezoelectric actuator 11 including an electromechanical conversion element as a driver (actuator and pressure generator) to deform the vibration region 30 of the diaphragm member 3 is disposed on the side opposite to the individual liquid chambers 6 of the diaphragm member 3.

This piezoelectric actuator 11 forms a required number of columnar piezoelectric elements 12 by groove processing on a piezoelectric member bonded to a base 13 by half cut dicing in a comb shape at predetermined intervals. The piezoelectric elements 12 are bonded to the vibration region (diaphragm) 30 of the diaphragm member 3. A flexible wiring member 15 is coupled to the piezoelectric elements 12.

In this liquid discharge head 100, for example, by lowering a voltage applied to the piezoelectric elements 12 from a reference potential (intermediate potential), the piezoelectric elements 12 contract, and the vibration region 30 of the diaphragm member 3 is drawn to expand the volume of each of the individual liquid chambers 6. As a result, a liquid flows into each of the individual liquid chambers 6.

Thereafter, the voltage applied to the piezoelectric elements 12 is increased to elongate the piezoelectric elements 12 in a laminating direction, and the vibration region 30 of the diaphragm member 3 is deformed in a direction toward the nozzles 4 to contract the volume of each of the individual liquid chambers 6. As a result, a liquid in each of the individual liquid chambers 6 is pressurized, and the liquid is discharged from the nozzles 4.

The liquid not discharged from the nozzles 4 passes through the nozzles 4 and is collected by the common collection channel 50 via the individual collection channels 58, and is again supplied to the common supply channel 10 from the common collection channel 50 via an external circulation channel.

A method for driving the head is not limited to the above example (pull-push striking), but pull-striking, push-striking, or the like can be performed depending on how to impart a driving waveform.

Next, the details of the channel configuration in the first embodiment will be described.

In the present embodiment, the common supply channel 10 and the common collection channel 50 are disposed side by side in a direction orthogonal to the nozzle arrangement direction so as to overlap with the individual liquid chambers 6 when the individual liquid chambers 6 are projected in the vertical direction.

Here, the common collection channel 50 is disposed at a position closer to the nozzles 4 than the common supply channel 10 in the direction orthogonal to the nozzle arrangement direction.

The common supply channel 10 communicates with the individual liquid chambers 6 on the side opposite to a side of the individual liquid chambers 6 communicating with the nozzles 4 (a side connected to the nozzle communication channels 5) via the individual supply channels 8 in the direction orthogonal to the nozzle arrangement direction. Meanwhile, the common collection channel 50 communicates with the individual liquid chambers 6 via the individual collection channels 58 and the nozzle communication channels 5 on a side of the individual liquid chambers 6 communicating with the nozzles 4 in the direction orthogonal to the nozzle arrangement direction.

In the present embodiment, if a liquid is discharged downward in the vertical direction, the common supply channel 10 and the common collection channel 50 are disposed below the individual liquid chambers 6 in the vertical direction. If a liquid is discharged downward in the vertical direction, the common supply channel 10 communicates with the individual liquid chambers 6 via the individual supply channels 8 on an upper side in the vertical direction, and the common collection channel 50 communicates with the individual liquid chambers 6 via the individual collection channels 58 on a lower side in the vertical direction.

As described above, the common supply channel 10 and the common collection channel 50 are disposed side by side in the direction orthogonal to the nozzle arrangement direction so as to overlap with the individual liquid chambers 6 when the individual liquid chambers 6 are projected in the vertical direction. As a result, the common supply channel 10 and the common collection channel 50 can be downsized in the direction orthogonal to the head nozzle arrangement direction.

The individual liquid chambers 6 and channels such as the common supply channel 10, the common collection channel 50, the individual supply channels 8, and the individual collection channels 58 can be disposed in the channel plate 2. As a result, it is only required to form the supply port 21 communicating with the common supply channel 10 and the collection port 22 communicating with the common collection channel 50 in the frame member 20, and a channel configuration can be downsized.

Figure 3:
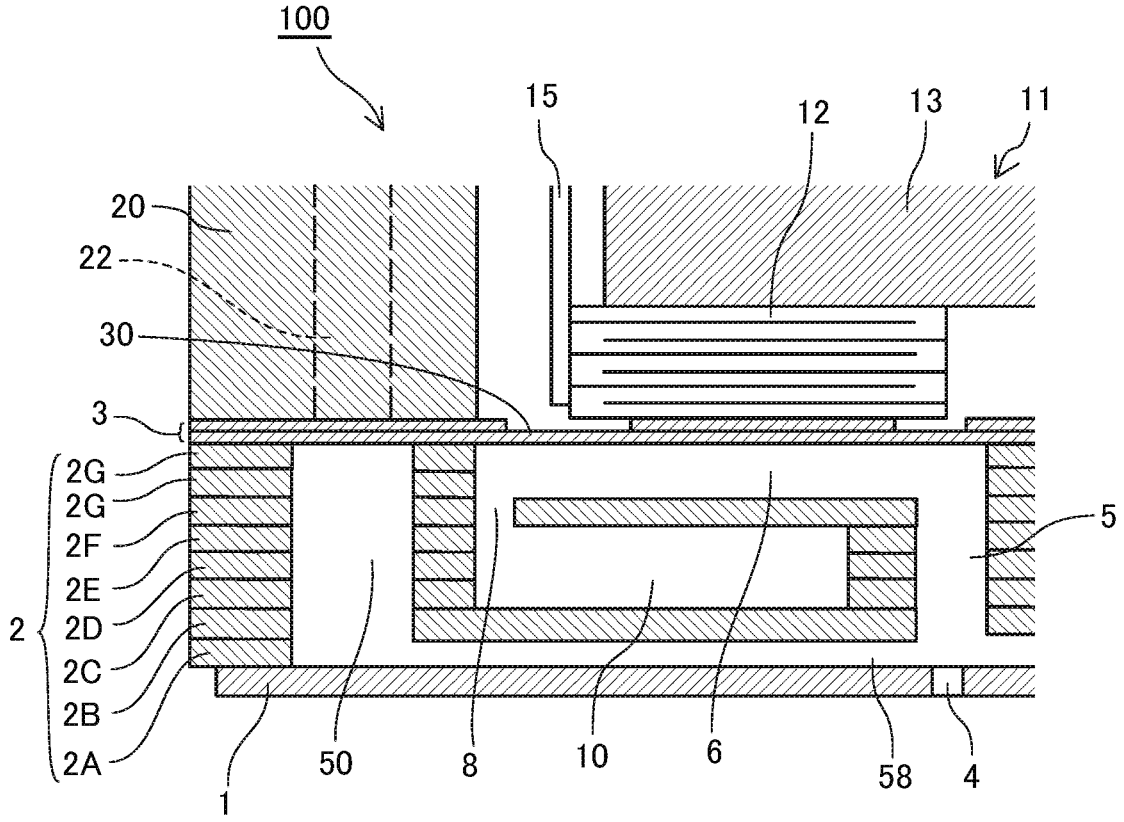
FIG. 3 is an explanatory cross-sectional view in a direction orthogonal to a nozzle arrangement direction of a liquid discharge head according to a second embodiment of the present disclosure.
Figure 4:
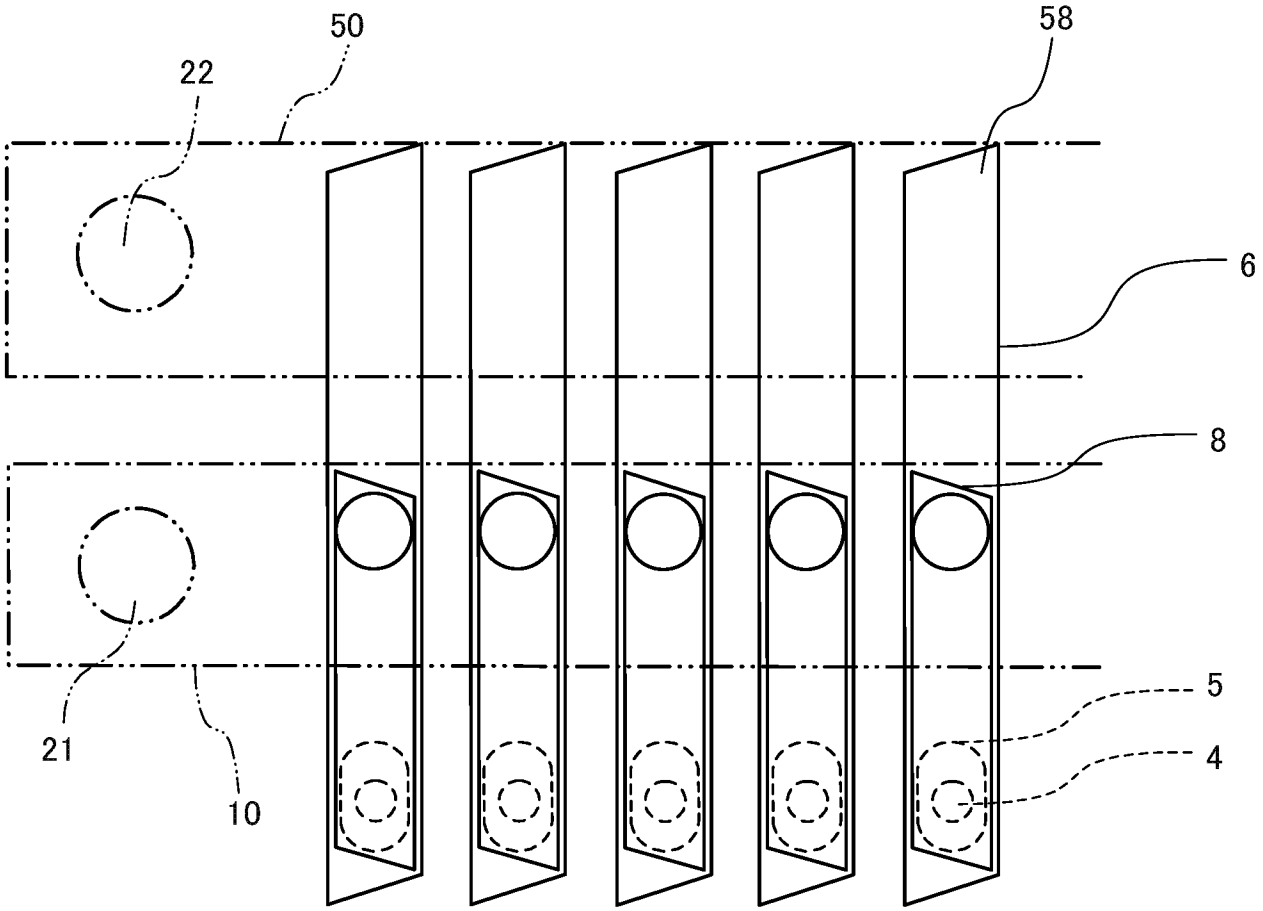
FIG. 4 is an explanatory plan view of the head.

Next, a second embodiment of the present disclosure will be described with reference to FIGS. 3 and 4. FIG. 3 is an explanatory cross-sectional view in a direction orthogonal to a nozzle arrangement direction of a liquid discharge head according to the second embodiment. FIG. 4 is an explanatory plan view of the head. FIG. 4 is a view of a side of nozzles viewed from individual liquid chambers.

In the present embodiment, a common supply channel 10 and a common collection channel 50 are disposed side by side in a direction orthogonal to a nozzle arrangement direction such that the common supply channel 10 overlaps with individual liquid chambers 6 and the common collection channel 50 does not overlap with the individual liquid chambers 6 when the individual liquid chambers 6 are projected in the vertical direction.

Here, the common supply channel 10 is disposed at a position closer to nozzles 4 than the common collection channel 50. The common supply channel 10 communicates with the individual liquid chambers 6 via individual supply channels 8 on the side opposite to a side of the individual liquid chambers 6 communicating with the nozzles 4 in the direction orthogonal to the nozzle arrangement direction. The common collection channel 50 communicates with the individual liquid chambers 6 via individual collection channels 58 on the side opposite to the individual liquid chambers 6 across the common supply channel 10.

In the present embodiment, if a liquid is discharged downward in the vertical direction, the common supply channel 10 is disposed below the individual liquid chambers 6 in the vertical direction. If a liquid is discharged downward in the vertical direction, the common supply channel 10 communicates with the individual liquid chambers 6 via the individual supply channels 8 on an upper side in the vertical direction, and the common collection channel 50 communicates with the individual liquid chambers 6 via the individual collection channels 58 on a lower side of in the vertical direction.

With such a configuration, it is possible to increase the volumes of the common supply channel 10 and the common collection channel 50 as compared with those in the first embodiment.

Figure 5:
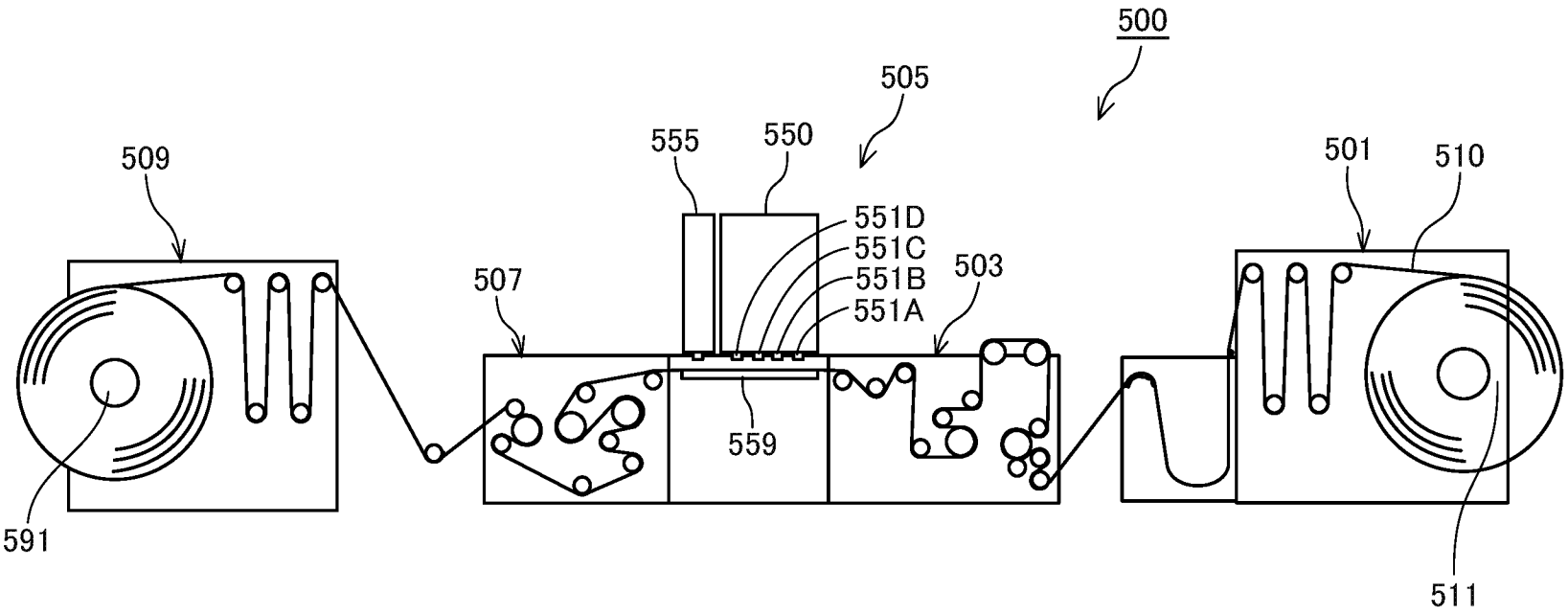
FIG. 5 is a schematic explanatory view of an example of a liquid discharge apparatus according to an embodiment of the present disclosure.
Figure 6:
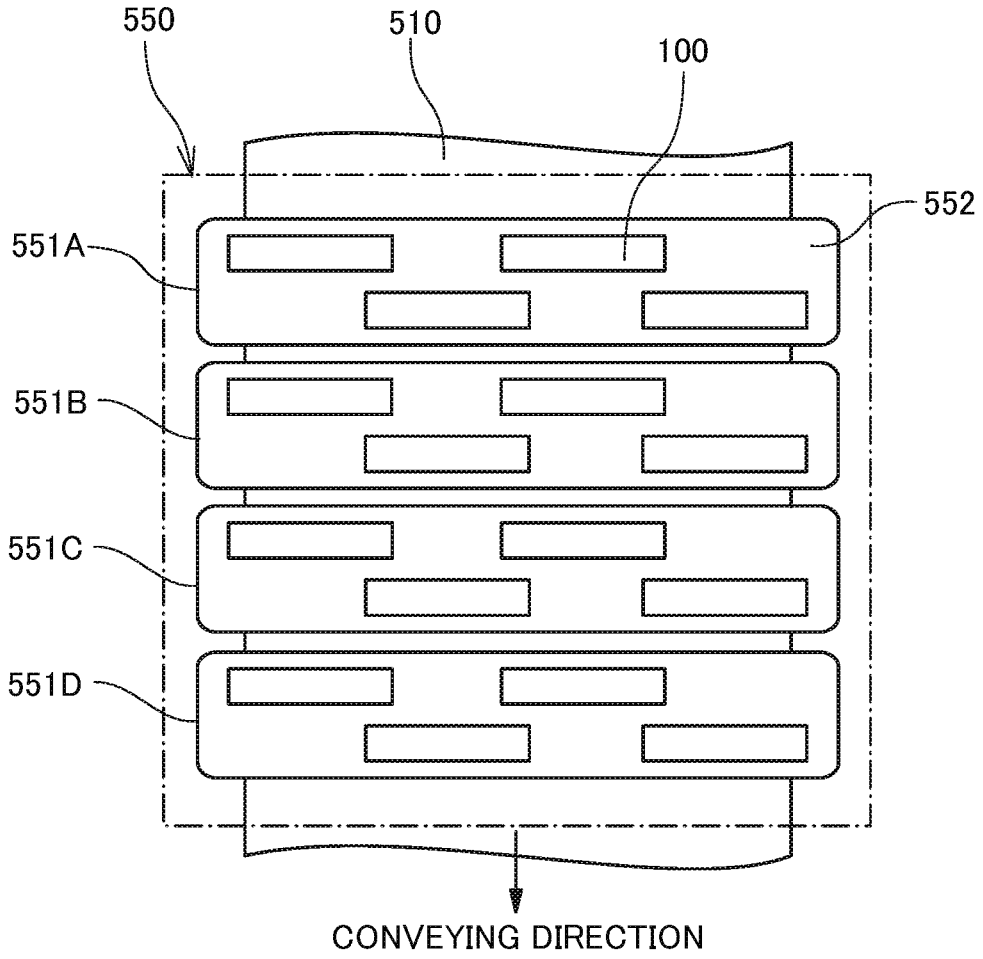
FIG. 6 is an explanatory plan view of an example of a head unit of the apparatus.

Next, an example of a liquid discharge apparatus according to an embodiment of the present disclosure will be described with reference to FIGS. 5 and 6. FIG. 5 is a schematic explanatory view of the apparatus. FIG. 6 is an explanatory plan view of an example of a head unit of the apparatus.

A printing apparatus 500 as the liquid discharge apparatus includes a feeder 501 to feed a continuum 510 in, a guiding conveyor 503 to guide and convey the continuum 510 fed from the feeder 501 into a printer 505, the printer 505 to discharge a liquid onto the continuum 510 and form an image to perform printing, a drier 507 to dry the continuum 510, a carrying-out unit 509 to carry the continuum 510 out, and the like.

The continuum 510 is fed out from an original winding roller 511 of the feeder 501, guided and conveyed by rollers of the feeder 501, the guiding conveyor 503, the drier 507, and the carrying-out unit 509, and wound by a winding roller 591 of the carrying-out unit 509.

In the printer 505, the continuum 510 is conveyed on a conveying guide 559 facing a head unit 550 and a head unit 555. An image is formed by a liquid discharged from the head unit 550. Post-treatment is performed with a treatment liquid discharged from the head unit 555.

The head unit 550 has, for example, full-line type head arrays 551A, 551B, 551C, and 551D for four colors (hereinafter, referred to as "head array 551" unless these arrays are distinguished from each other) disposed from an upstream side in a conveying direction.

The head arrays 551 are liquid discharge means, and discharge liquids of black K, cyan C, magenta M, and yellow Y onto the continuum 510 conveyed, respectively. The type and number of colors are not limited thereto.

As illustrated in FIG. 6, for example, the head array 551 is formed by disposing liquid discharge heads (also simply referred to as "heads") 100 in a staggered pattern on a base 552. However, the head array 551 is not limited thereto.

Figure 7:
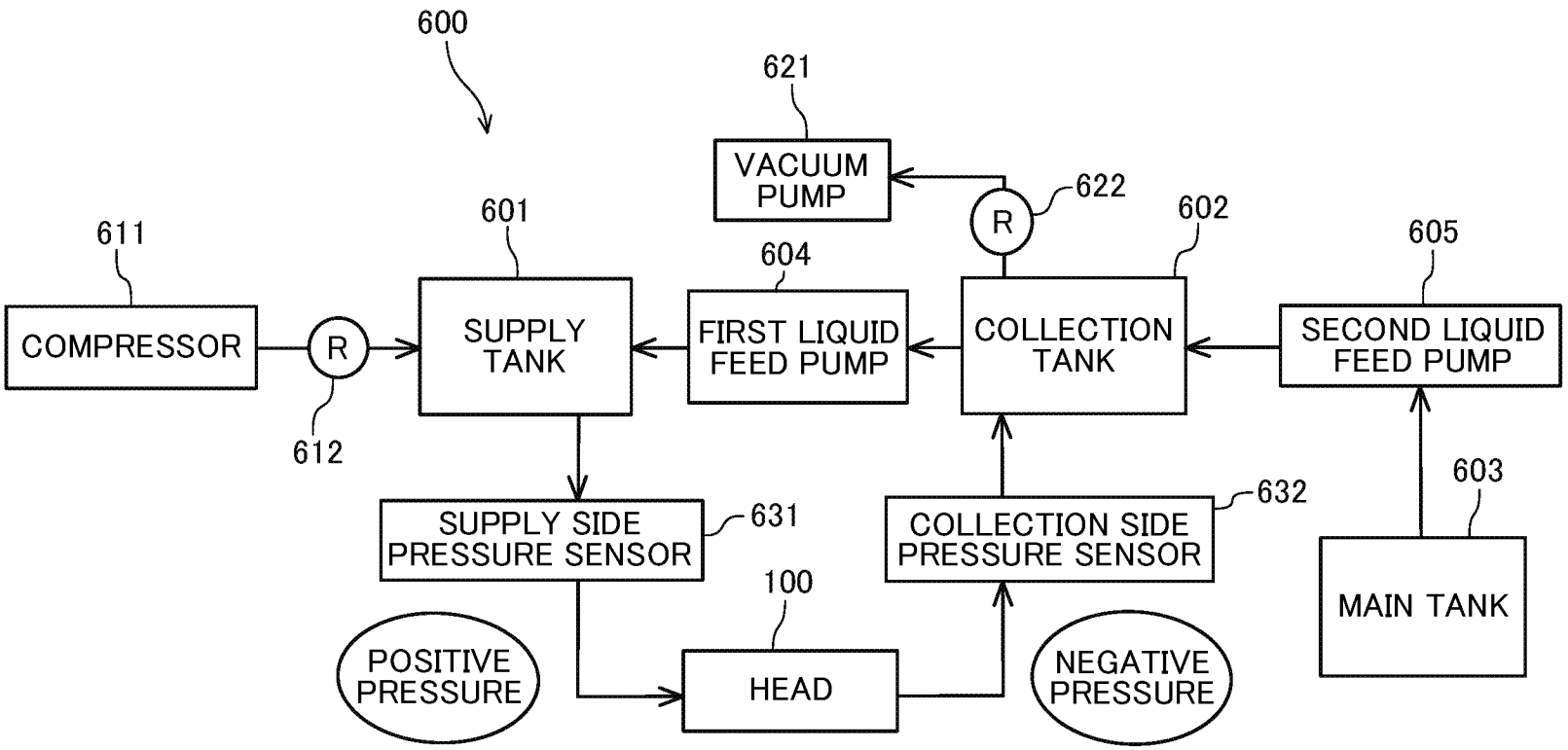
FIG. 7 is an explanatory block diagram of an example of a liquid circulation device.

Next, an example of a liquid circulation device will be described with reference to FIG. 7. FIG. 7 is an explanatory block diagram of the circulation device. Only one head is illustrated here. However, in a case where a plurality of heads is disposed, a supply side liquid channel and a collection side liquid channel are coupled to a supply side and a collection side of each of the plurality of heads via a manifold or the like, respectively.

A liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply side pressure sensor 631, a collection side pressure sensor 632, and the like.

Here, the compressor 611 and the vacuum pump 621 constitute a unit to generate a differential pressure between the pressure in the supply tank 601 and the pressure in the collection tank 602.

The supply side pressure sensor 631 is disposed between the supply tank 601 and a head 100 and coupled to a supply side liquid channel connected to a supply port 21 of the head 100. The collection side pressure sensor 632 is disposed between the head 100 and the collection tank 602 and coupled to a collection side liquid channel connected to a collection port 22 of the head 100.

One side of the collection tank 602 is coupled to the supply tank 601 via the first liquid feed pump 604, and the other side of the collection tank 602 is coupled to the main tank 603 via the second liquid feed pump 605.

As a result, a liquid flows from the supply tank 601 into the head 100 through the supply port 21, collected by the collection tank 602 via the collection port 22, and fed from the collection tank 602 to the supply tank 601 by the first liquid feed pump 604 to form a circulation channel in which the liquid is circulated.

Here, the compressor 611 is connected to the supply tank 601, and control is performed such that a predetermined positive pressure is detected by the supply side pressure sensor 631. Meanwhile, the vacuum pump 621 is connected to the collection tank 602, and control is performed such that a predetermined negative pressure is detected by the collection side pressure sensor 632.

As a result, a negative pressure of a meniscus can be kept constant while a liquid is circulated through the head 100.

When a liquid is discharged from the nozzles 4 of the head 100, the liquid amount in the supply tank 601 and the collection tank 602 decreases. Therefore, the collection tank 602 is replenished with a liquid from the main tank 603 appropriately using the second liquid feed pump 605.

The timing of replenishing the collection tank 602 with a liquid from the main tank 603 can be controlled according to a detection result of a liquid surface sensor or the like in the collection tank 602, for example, the collection tank 602 is replenished with a liquid when a liquid surface height of a liquid in the collection tank 602 falls below a predetermined height.

Figure 8:
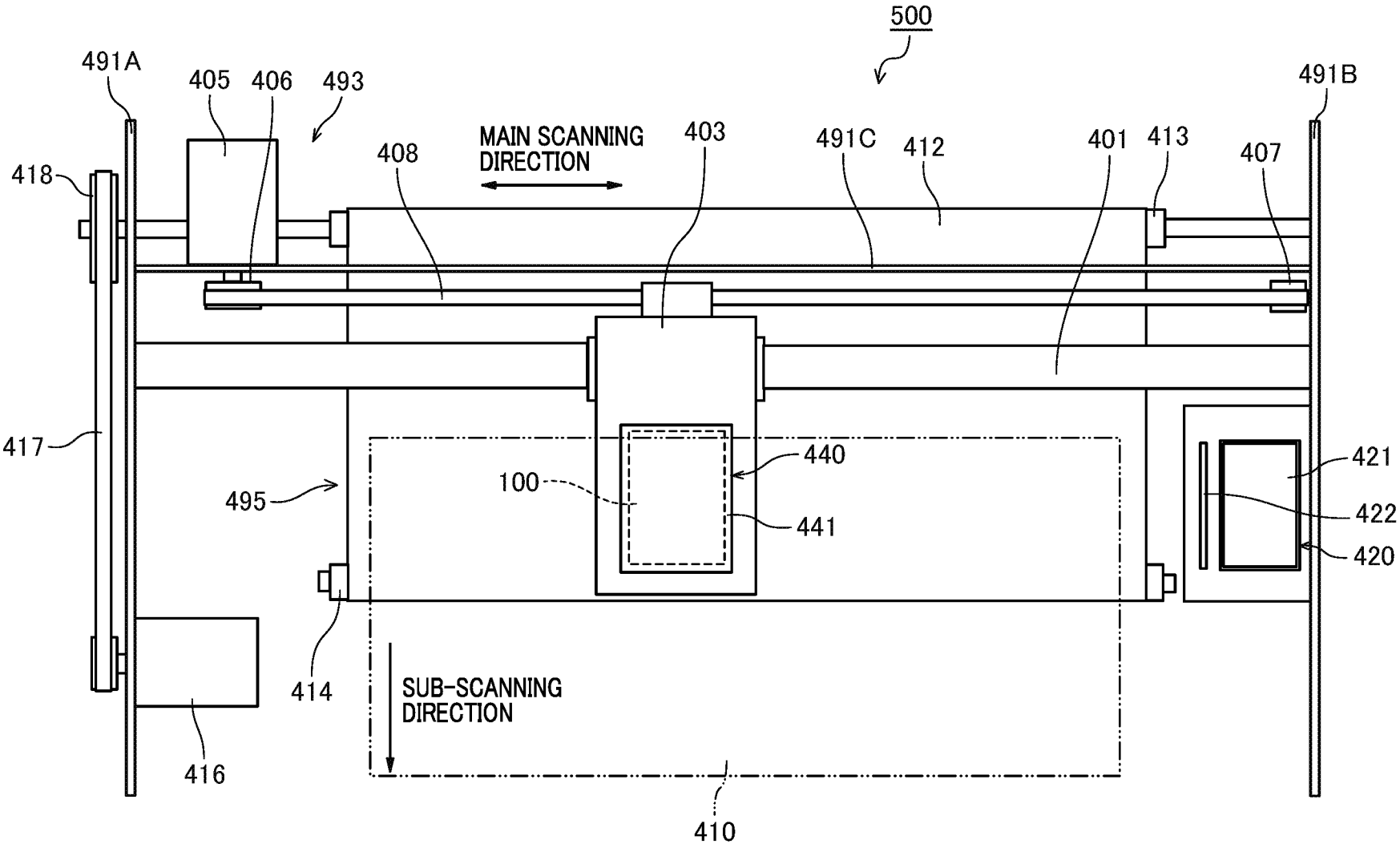
FIG. 8 is an explanatory plan view of a main portion of another example of the liquid discharge apparatus according to an embodiment of the present disclosure.
Figure 9:
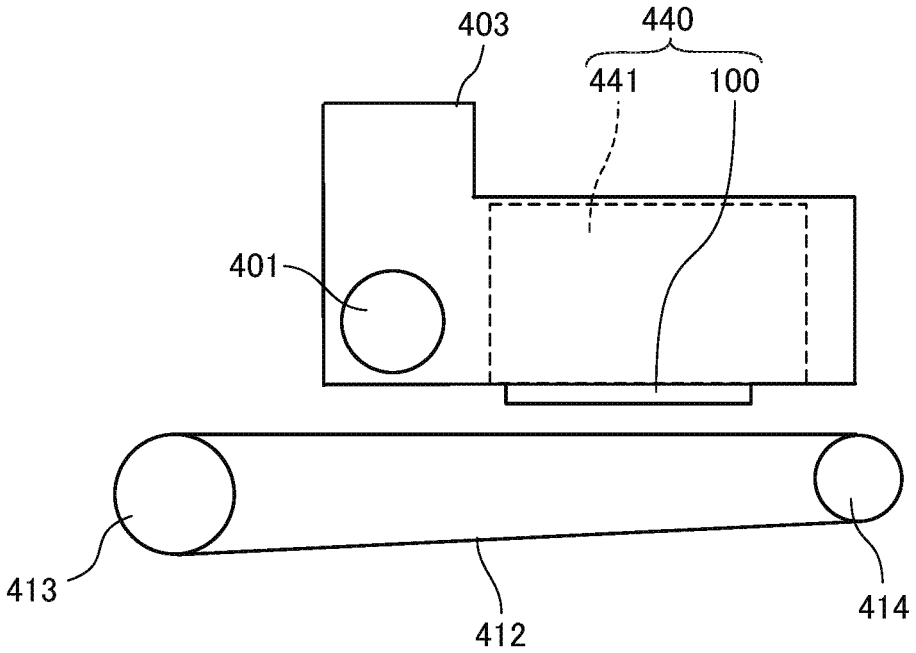
FIG. 9 is an explanatory side view of a main portion of the apparatus.

Next, another example of the printing apparatus as the liquid discharge apparatus according to an embodiment of the present disclosure will be described with reference to FIGS. 8 and 9. FIG. 8 is an explanatory plan view of a main portion of the apparatus. FIG. 9 is an explanatory side view of a main portion of the apparatus.

The printing apparatus 500 is a serial type apparatus, and a carriage 403 reciprocates in a main scanning direction by a main scanning movement mechanism 493. The main scanning movement mechanism 493 includes a guide member 401, a main scanning motor 405, a timing belt 408, and the like. The guide member 401 is stretched between left and right side plates 491A and 491B to movably hold the carriage 403. The main scanning motor 405 reciprocates the carriage 403 in the main scanning direction via the timing belt 408 stretched between a driving pulley 406 and a driven pulley 407.

The carriage 403 has a liquid discharge device 440 formed by integrating the liquid discharge head 100 according to an embodiment of the present disclosure with a head tank 441 mounted thereon. The liquid discharge head 100 of the liquid discharge device 440 discharges liquids of colors of, for example, yellow (Y), cyan (C), magenta (M), and black (K). The liquid discharge head 100 has a nozzle row including a plurality of nozzles disposed and attached in a sub-scanning direction orthogonal to the main scanning direction with a discharge direction downward.

The liquid discharge head 100 is coupled to the above-described liquid circulation device 600, and a liquid of a required color is circulated and supplied to the liquid discharge head 100.

The printing apparatus 500 includes a conveying mechanism 495 to convey a sheet 410. The conveying mechanism 495 includes a conveying belt 412 as a conveying member and a sub-scanning motor 416 to drive the conveying belt 412.

The conveying belt 412 attracts the sheet 410 and conveys the sheet 410 at a position facing the liquid discharge head 100. The conveying belt 412 is an endless belt, and is stretched between a conveying roller 413 and a tension roller 414. Attraction can be performed by electrostatic attraction, air suction, or the like.

The conveying belt 412 is rotated and moved in the sub-scanning direction by rotation driving of the conveying roller 413 via a timing belt 417 and a timing pulley 418 by the sub-scanning motor 416.

Furthermore, on one side of the carriage 403 in the main scanning direction, a maintenance and recovery mechanism 420 to maintain and recover the liquid discharge head 100 is disposed on a side of the conveying belt 412.

The maintenance and recovery mechanism 420 includes, for example, a cap member 421 to cap a nozzle surface (surface on which nozzles are formed) of the liquid discharge head 100 and a wiper member 422 to wipe the nozzle surface.

The main scanning movement mechanism 493, the maintenance and recovery mechanism 420, and the conveying mechanism 495 are attached to a housing including the side plates 491A and 491B and a back plate 491C.

In the printing apparatus 500 having such a configuration, the sheet 410 is fed onto and attracted by the conveying belt 412, and conveyed in the sub-scanning direction by rotating movement of the conveying belt 412.

Therefore, by driving the liquid discharge head 100 in accordance with an image signal while the carriage 403 is moved in the main scanning direction, a liquid is discharged onto the sheet 410 being stopped to form an image.

Figure 10:
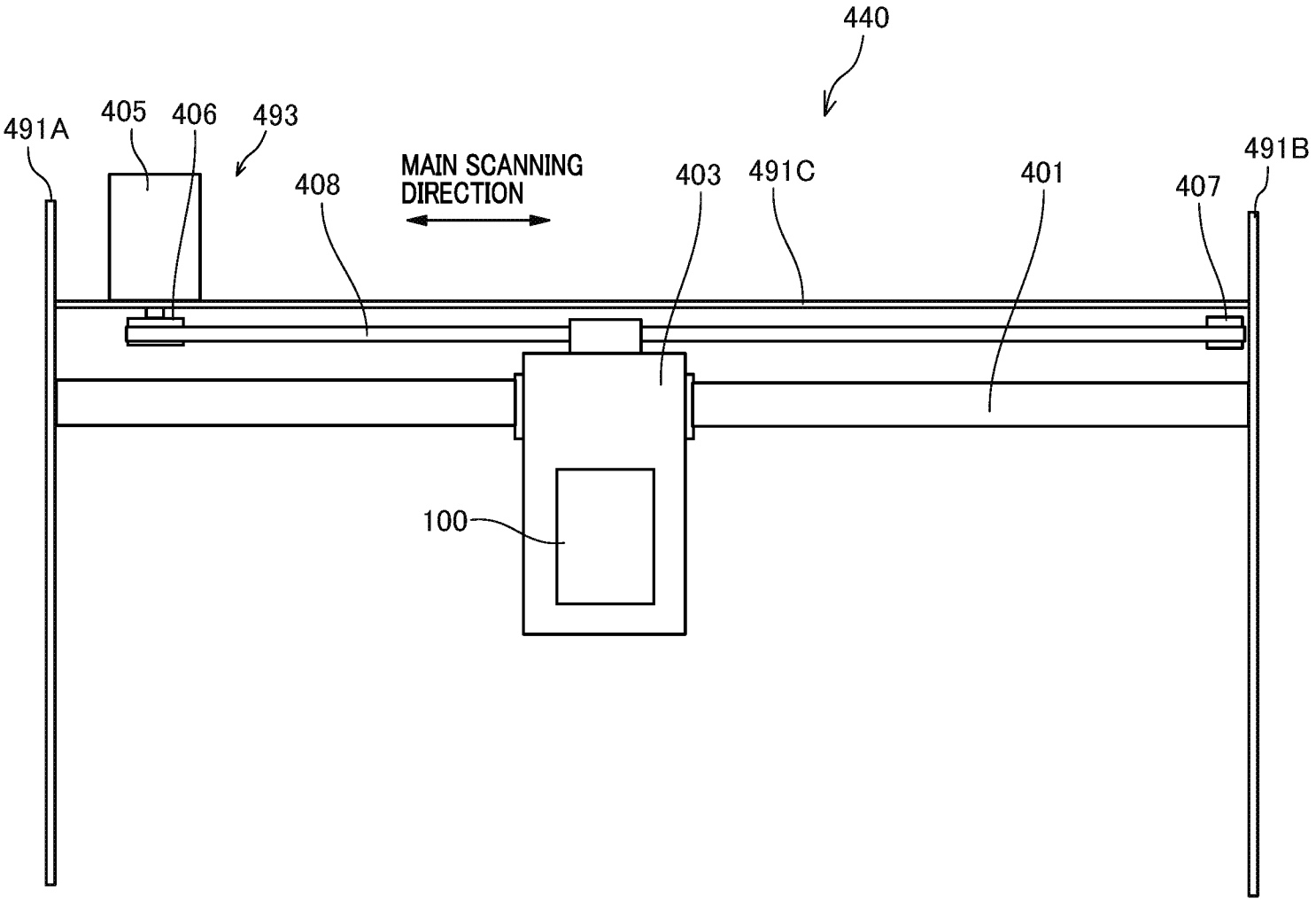
FIG. 10 is an explanatory plan view of a main portion of another example of the liquid discharge device according to an embodiment of the present disclosure.

Next, another example of the liquid discharge device according to an embodiment of the present disclosure will be described with reference to FIG. 10. FIG. 10 is an explanatory plan view of a main portion of the unit.

A liquid discharge device 440 includes a housing portion including the side plates 491A and 491B and the back plate 491C, the main scanning movement mechanism 493, the carriage 403, and the liquid discharge head 100 out of the members constituting the liquid discharge apparatus.

It is also possible to form a liquid discharge device having the above-described maintenance and recovery mechanism 420 further attached to, for example, the side plate 491B of the liquid discharge device 440.

Figure 11:
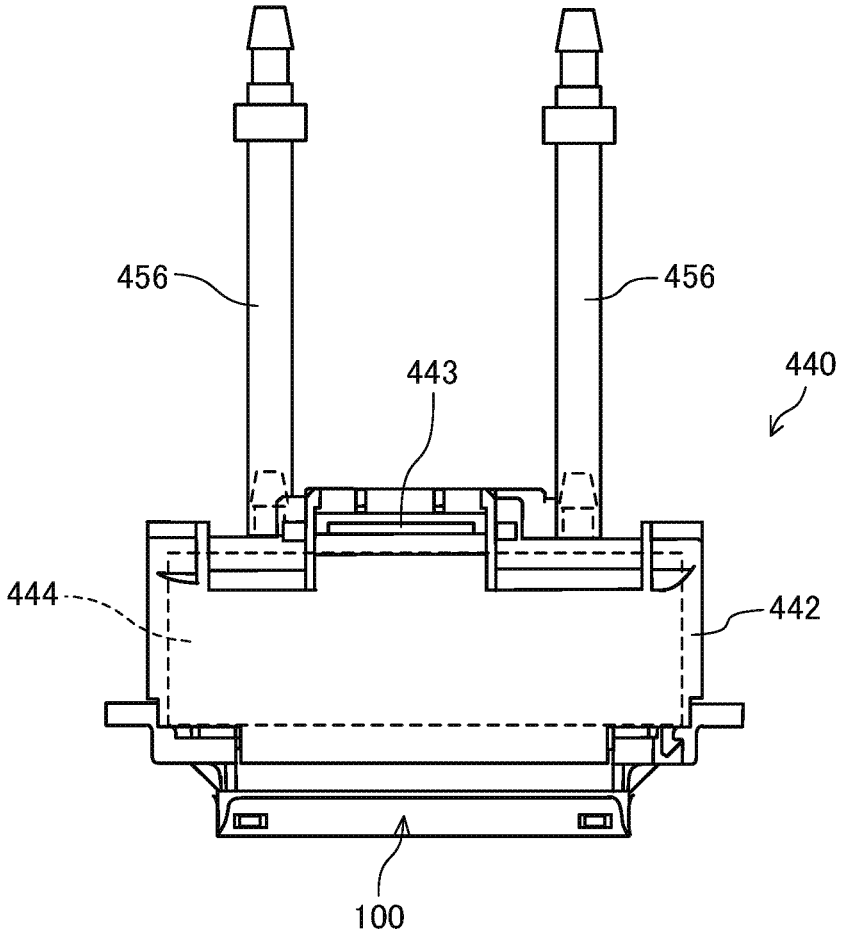
FIG. 11 is an explanatory front view of still another example of the liquid discharge device according to an embodiment of the present disclosure.

Next, still another example of the liquid discharge device according to an embodiment of the present disclosure will be described with reference to FIG. 11. FIG. 11 is an explanatory front view of the unit.

The liquid discharge device 440 includes the liquid discharge head 100 attached with a channel component 444 and tubes 456 coupled to the channel component 444.

The channel component 444 is disposed in a cover 442. Instead of the channel component 444, a head tank 441 can be included. The channel component 444 includes a connector 443 to electrically connect the channel component 444 to the liquid discharge head 100 on an upper portion thereof.

In the present disclosure, a liquid to be discharged may be any liquid as long as having a viscosity and surface tension that can be discharged from a head, and is not particularly limited, but preferably has a viscosity of 30 mPa·s or less at ordinary temperature and normal pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as DNA, amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

Examples of an energy generation source to discharge a liquid include those using a piezoelectric actuator (a laminated type piezoelectric element and a thin film type piezoelectric element), a thermal actuator using an electrothermal transducer such as a heating resistor, and an electrostatic actuator including a diaphragm and a counter electrode.

The "liquid discharge device" is formed by integrating a functional component and a mechanism with a liquid discharge head, and includes an assembly of components related to discharge of a liquid. Examples of the "liquid discharge device" include a unit formed by combining at least one of configurations of a head tank, a carriage, a supply mechanism, a maintenance and recovery mechanism, a main scanning movement mechanism, and a liquid circulation device with a liquid discharge head.

Here, examples of the integration include a case where a liquid discharge head, a functional component, and a mechanism are secured to each other by fastening, bonding, engagement, or the like and a case where one is held movably with respect to the other. A liquid discharge head, a functional component, and a mechanism may be detachable from each other.

Examples of the liquid discharge device include a unit in which a liquid discharge head and a head tank are integrated with each other. Examples of the liquid discharge device further include a unit in which a liquid discharge head and a head tank are coupled to each other with a tube or the like to be integrated with each other. Here, a unit including a filter may be added between a head tank of the liquid discharge device and a liquid discharge head.

Examples of the liquid discharge device further include a unit in which a liquid discharge head and a carriage are integrated with each other.

Examples of the liquid discharge device further include a unit in which a liquid discharge head is movably held by a guide member constituting a part of a main scanning movement mechanism to integrate the liquid discharge head and the main scanning movement mechanism with each other. Example of the liquid discharge device further include a unit in which a liquid discharge head, a carriage, and a main scanning movement mechanism are integrated with each other.

Examples of the liquid discharge device further include a unit in which a cap member as a part of a maintenance and recovery mechanism is secured to a carriage to which a liquid discharge head is attached to integrate the liquid discharge head, the carriage, and the maintenance and recovery mechanism with each other.

Examples of the liquid discharge device further include a unit in which a tube is coupled to a liquid discharge head to which a head tank or a channel component is attached to integrate the liquid discharge head and a supply mechanism with each other. A liquid in a liquid storage source is supplied to the liquid discharge head via the tube (e.g., the tube 456).

The main scanning movement mechanism also includes a single guide member. The supply mechanism also includes a single tube and a single loading unit.

The "liquid discharge apparatus" includes an apparatus including a liquid discharge head or a liquid discharge device, the apparatus driving a liquid discharge head to discharge a liquid. The "liquid discharge apparatus" includes not only an apparatus capable of discharging a liquid onto a liquid-attachable object but also an apparatus that discharges a liquid toward a gas or a liquid.

The "liquid discharge apparatus" may also include units or members related to feeding, conveying, or sheet ejection of a liquid-attachable object, a pretreatment device, a post-treatment device, and the like.

Examples of the "liquid discharge apparatus" include an image forming apparatus that discharges an ink to form an image on a sheet and a stereoscopic modeling apparatus (three-dimensional modeling apparatus) that discharges a modeling liquid onto a powder layer obtained by forming a powder into a layer shape in order to model a stereoscopic modeled object (three-dimensional modeled object).

The "liquid discharge apparatus" is not limited to an apparatus in which a significant image such as a letter or a graphic is visualized by a discharged liquid. Examples of the "liquid discharge apparatus" include an apparatus that forms a pattern or the like having no meaning by itself and an apparatus that models a three-dimensional image.

The "liquid-attachable object" means an object to which a liquid can be attached at least temporarily, and means an object causing adhesion by attachment, an object causing permeation by attachment, or the like. Specific examples of the "liquid-attachable object" include a recording medium such as a sheet, recording paper, a recording sheet, a film, or a cloth, an electronic component such as an electronic substrate or a piezoelectric element, and a medium such as a powder layer (powdery layer), an organ model, or an inspection cell. Unless particularly limited, the "liquid-attachable object" includes everything to which a liquid is attached.

A material of the "liquid-attachable object" may be any material as long as a liquid can be attached to the object even temporarily, such as paper, yarn, fiber, cloth, leather, metal, plastic, glass, wood, or ceramics.

The "liquid discharge apparatus" includes an apparatus in which a liquid discharge head and a liquid-attachable object move relatively to each other, but is not limited thereto. Specific examples thereof include a serial type apparatus that moves a liquid discharge head and a line type apparatus that does not move a liquid discharge head.

Examples of the "liquid discharge apparatus" further include a treatment liquid application apparatus that discharges a treatment liquid onto a sheet in order to apply the treatment liquid to a surface of the sheet, for example, in order to modify the surface of the sheet, and a spraying granulation apparatus that sprays a composition liquid in which a raw material is dispersed in a solution via a nozzle to granulate fine particles of the raw material.

In the terms of the present application, image formation, recording, letter printing, photograph printing, printing, modeling, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge head, comprising:

a plurality of nozzles to discharge a liquid;

a plurality of individual liquid chambers communicating with the plurality of nozzles, respectively;

a common supply channel communicating with the plurality of individual liquid chambers; and a common collection channel communicating with the plurality of individual liquid chambers, wherein the common supply channel and the common collection channel do not overlap in a direction orthogonal to a nozzle arrangement direction in which the plurality of nozzles is arranged when the common supply channel and the common collection channel are projected in a vertical direction of discharge of the liquid from the nozzles.

2. The liquid discharge head according to claim 1, wherein at least a part of the common supply channel and at least a part of the common collection channel are disposed side by side in the direction orthogonal to the nozzle arrangement direction in which the plurality of nozzles is arranged.

3. The liquid discharge head according to claim 1, wherein the common collection channel is disposed at a position closer to the plurality of nozzles than the common supply channel.

4. The liquid discharge head according to claim 3, further comprising a plurality of individual supply channels and a plurality of individual collection channels, wherein the common supply channel communicates with the plurality of individual liquid chambers via the plurality of individual supply channels on a first side opposite to a second side of the plurality of individual liquid chambers communicating with the plurality of nozzles in a direction orthogonal to the nozzle arrangement direction in which the plurality of nozzles is arranged, and wherein the common collection channel communicates with the plurality of individual liquid chambers via the plurality of individual collection channels on the second side of the plurality of individual liquid chambers communicating with the plurality of nozzles in the direction orthogonal to the nozzle arrangement direction.

5. The liquid discharge head according to claim 1, wherein the common supply channel is disposed at a position closer to the plurality of nozzles than the common collection channel.

6. The liquid discharge head according to claim 5, further comprising a plurality of individual supply channels and a plurality of individual collection channels, wherein the common supply channel communicates with the plurality of individual liquid chambers via the plurality of individual supply channels on a first side opposite to a second side of the plurality of individual liquid chambers communicating with the plurality of nozzles in the direction orthogonal to the nozzle arrangement direction in which the plurality of nozzles is arranged, and the common collection channel communicates with the plurality of individual liquid chambers via the plurality of individual collection channels on a side opposite to the plurality of individual liquid chambers across the common supply channel.

7. The liquid discharge head according to claim 1, wherein at least a part of at least one of the common supply channel and the common collection channel is disposed below the plurality of individual liquid chambers in the vertical direction, and wherein the liquid discharge head is to discharge the liquid downward from the plurality of nozzles in the vertical direction.

8. The liquid discharge head according to claim 1, wherein the common supply channel communicates with the plurality of individual liquid chambers on an upper side of the common supply channel in the vertical direction, and wherein the liquid discharge head is to discharge the liquid downward from the plurality of nozzles in the vertical direction.

9. The liquid discharge head according to claim 1, wherein the common collection channel communicates with the plurality of individual liquid chambers on a lower side of the common collection channel in the vertical direction, and wherein the liquid discharge head is to discharge the liquid downward from the plurality of nozzles in the vertical direction.

10. A liquid discharge device comprising the liquid discharge head according to claim 1.

11. The liquid discharge device according to claim 10, wherein the liquid discharge head is integrated as a single unit with at least one of:

a head tank to store the liquid to be supplied to the liquid discharge head;

a carriage on which the liquid discharge head is mounted;

a supply mechanism to supply the liquid to the liquid discharge head;

a maintenance and recovery mechanism to perform maintenance and recovery of the liquid discharge head; and a main scanning movement mechanism to move the liquid discharge head in a main scanning direction.

12. A liquid discharge apparatus comprising the liquid discharge device according to claim 10.

13. A liquid discharge apparatus comprising the liquid discharge head according to claim 1.

14. The liquid discharge head of claim 1, wherein at least part of the common supply channel and at least part of the common collection channel are disposed at a same level in the vertical direction.

15. A liquid discharge head, comprising:

a plurality of nozzles to discharge a liquid;

a plurality of individual liquid chambers communicating with the plurality of nozzles, respectively;

a common supply channel communicating with the plurality of individual liquid chambers; and a common collection channel communicating with the plurality of individual liquid chambers, wherein at least a part of at least one of the common supply channel and the common collection channel is disposed at a position overlapping with the plurality of individual liquid chambers when the plurality of individual liquid chambers are projected in a vertical direction, and the common supply channel is disposed at a position closer to the plurality of nozzles than the common collection channel.

16. A liquid discharge device comprising the liquid discharge head according to claim 15.

17. A liquid discharge apparatus comprising the liquid discharge head according to claim 15.

18. A liquid discharge head, comprising:

a plurality of nozzles to discharge a liquid;

a plurality of individual liquid chambers communicating with the plurality of nozzles, respectively;

a common supply channel communicating with the plurality of individual liquid chambers; and a common collection channel communicating with the plurality of individual liquid chambers, wherein at least a part of at least one of the common supply channel and the common collection channel is disposed at a position overlapping with the plurality of individual liquid chambers when the plurality of individual liquid chambers are projected in a vertical direction, at least a part of at least one of the common supply channel and the common collection channel is disposed below the plurality of individual liquid chambers in the vertical direction, and the liquid discharge head is to discharge the liquid downward from the plurality of nozzles in the vertical direction.

19. A liquid discharge device comprising the liquid discharge head according to claim 18.

20. A liquid discharge apparatus comprising the liquid discharge head according to claim 18.

* * * * *